US006702145B2

(12) United States Patent
Malcolm

(10) Patent No.: US 6,702,145 B2
(45) Date of Patent: Mar. 9, 2004

(54) SPLASH-PROOF LID FOR A CUP

(76) Inventor: Alexander R. Malcolm, 45 Regina Dr., W. Greenwich, RI (US) 02817

( * ) Notice: Subject to any disclaimer, the term of this patent is extended or adjusted under 35 U.S.C. 154(b) by 113 days.

(21) Appl. No.: 09/963,045

(22) Filed: Sep. 25, 2001

(65) Prior Publication Data

US 2002/0038803 A1 Apr. 4, 2002

Related U.S. Application Data

(60) Provisional application No. 60/235,948, filed on Sep. 26, 2000.

(51) Int. Cl.[7] ..... A47G 19/22

(52) U.S. Cl. ..... 220/713; 220/719; 220/731

(58) Field of Search ..... 220/711, 713, 220/716, 719, 731, 730; 210/474, 477, 484

(56) References Cited

U.S. PATENT DOCUMENTS

| | | | | | |
|---|---|---|---|---|---|
| 1,483,498 | A | * | 2/1924 | Zolnerevich | 210/244 |
| 2,885,084 | A | * | 5/1959 | Rocca | 210/464 |
| 4,056,210 | A | | 11/1977 | Boyle | |
| 4,106,660 | A | | 8/1978 | Boyle | |
| 4,322,014 | A | | 3/1982 | Philip | |
| 4,394,928 | A | | 7/1983 | Philip | |
| 4,478,346 | A | * | 10/1984 | Spong | 220/711 |
| 4,503,992 | A | | 3/1985 | Sitko et al. | |
| 4,589,569 | A | | 5/1986 | Clements | |
| 4,605,499 | A | * | 8/1986 | Wise | 210/282 |
| 4,767,019 | A | | 8/1988 | Horner | |
| 4,953,743 | A | | 9/1990 | Dart et al. | |
| 5,065,880 | A | | 11/1991 | Horner | |
| 5,168,140 | A | * | 12/1992 | Welker | 99/323 |
| 5,503,289 | A | * | 4/1996 | Fox | 220/713 |
| 5,860,558 | A | * | 1/1999 | Fahy | 220/719 |
| 6,220,476 | B1 | * | 4/2001 | Waller | 220/719 |
| 6,263,781 | B1 | * | 7/2001 | Calagui | 210/477 |
| 6,305,571 | B1 | * | 10/2001 | Chu | 220/719 |
| 2002/0003145 | A1 | * | 1/2002 | Milan | 220/713 |

FOREIGN PATENT DOCUMENTS

| | | | |
|---|---|---|---|
| FR | 2771720 | * | 6/1999 |

* cited by examiner

*Primary Examiner*—Nathan J. Newhouse
(74) *Attorney, Agent, or Firm*—McCarter & English, LLP

(57) ABSTRACT

A splash-proof lid for a drinking cup has a splash guard in the form of a semi-permeable membrane positioned between the liquid contents of the cup and a discharge opening of the lid. The splash guard inhibits the liquid from splashing out of the discharge opening, while permitting the liquid to flow therethrough to the discharge opening.

19 Claims, 12 Drawing Sheets

SPLASH-PROOF LID FOR A CUP

CROSS REFERENCE TO RELATED APPLICATIONS

This is a §111 (a) application relating to a U.S. Appln. Ser. No. 60/235,948 filed Sep. 26, 2000.

FIELD OF THE INVENTION

The present invention relates to lids for drinking cups and, more particularly, to such lids which inhibit the liquid contents of the cups from splashing out through a discharge opening in the lids.

BACKGROUND OF THE INVENTION

Hot and cold beverages, such as coffee, juice and the like, are typically served in single-serving containers or disposable cups having a removable lid. Frequently, these disposable cups are intended for "take-out" use, such usage often resulting in inadvertent splashing of the hot or cold liquid contents from the interior of the cups through the discharge outlet of their associated lids. If the liquid contents are hot, their inadvertent discharge from the cup can cause painful injuries, property damage, accidents and other undesirable results.

For example, on trains, airlines, ships and the like, it is customary to serve beverages to the passengers. The movement of these vehicles often causes the liquids to jiggle and splash out from the covered cup. To minimize splashing of such beverages from out of the cup, the dispensed liquids are frequently served in a partially filled cup or container, i.e., being only two-thirds filled. In this situation, to prevent any splashing problems, the underfilling prevents the consumer from getting a full measure of the beverage within the cup. In addition, when consumers purchase hot beverages, such as coffee, for their "take-out" use in a vehicle, the users must waste some of the purchased beverage by pouring some liquid out of the cup to prevent the splashing of its liquid contents during the movement of the consumers' vehicle.

The prior art describes various efforts to produce a splash-proof lid to alleviate the aforementioned problems. However, the previously disclosed devices either involve complex lid geometries which can not be economically molded or relate only to reducing the splashing-out propensity of the lid by limiting the circumstances of use.

For example, U.S. Pat. Nos. 4,322,014 and 4,394,928 to Philip disclose a splash-proof cover for a container. More particularly, the cover includes a barrier member that acts as a splash shield. The barrier member is located on the bottom surface of the cover and extends under and across the liquid for preventing liquid from being splashed out from the covered container. Each of these devices reveal a very complex geometric lid design which may not completely prevent the splashing of liquid from the cup. Further, this lid structure may not be economically molded.

U.S. Pat. No. 4,503,992 to Sitko et al. discloses a snap-on lid for a cup having a drinking orifice therein. The lid further includes a flange that slopes downwardly around the inner periphery of the drinking orifice adjacent to one side of the lid. The flange only partially reduces splashing out which might occur due to the inadvertent movement of the cup when in a moving vehicle. The flange is also inadequate in that it is only located adjacent to the drinking orifice and does not adequately block any splashing of liquid from the cup when jarred or jiggled during vehicular movement.

U.S. Pat. No. 4,767,019 to Horner discloses a spill-resistant lid for a cup. The lid includes a raised oval which, when depressed by the user, becomes an interior canopy (depressed oval) which deflects fluid from splashing-out of the lid but also permits a metered flow of fluid from openings on each side of the interior canopy when the user is drinking the fluid. The interior canopy does not adequately block any splashing of fluid from the cup when jarred or jiggled during vehicular movement.

As in the foregoing circumstances, it is an object of the present invention to provide a splash-proof lid having a splash guard therein for preventing the splashing of a hot or cold beverage from the discharge opening of the lid.

SUMMARY OF THE INVENTION

In accordance with the present invention, a new and improved splash-proof lid for a drinking cup includes a splash guard which is made from a semi-permeable material, such as a non-woven fiber substrate. The splash guard underlies a discharge opening in the lid so as to inhibit liquid in an associated cup from splashing out of the discharge opening, while permitting the liquid to flow therethrough to the discharge opening. The splash guard can be angled relative to a plane which contains the discharge opening such that the undrunk liquid drains back into the cup from the lid. Because the splash guard is inexpensive to manufacture and attach to the lid, the lid and splash guard can be disposed of after a single use.

BRIEF DESCRIPTION OF THE DRAWINGS

Further objects, features and advantages of the present invention will become apparent upon consideration of the following detailed description of various exemplary embodiments considered in conjunction with the accompanying drawings, in which.

DETAILED DESCRIPTION OF THE EXEMPLARY EMBODIMENTS

Figure 1:
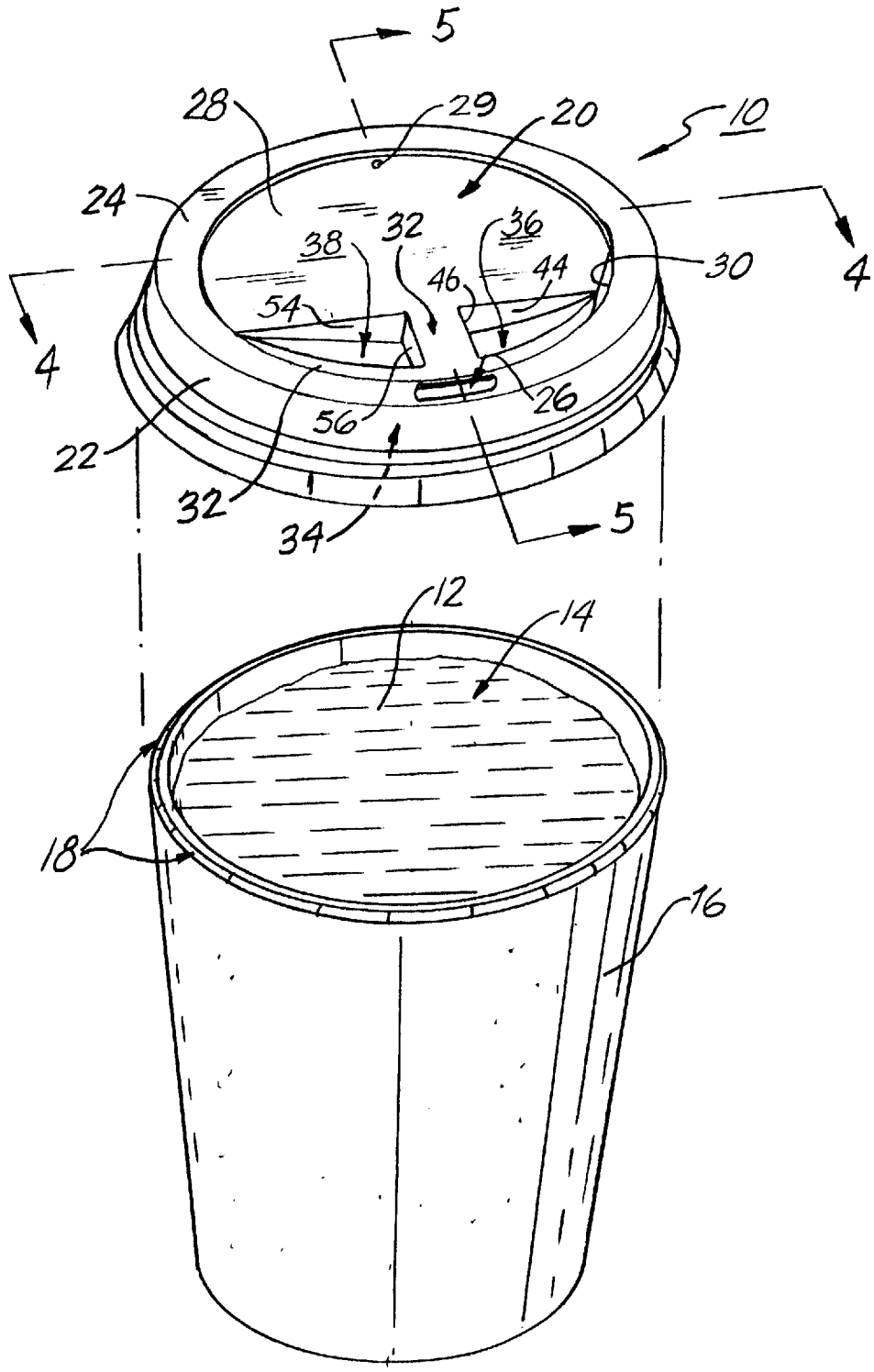
FIG. 1 is an exploded top perspective view of a drinking cup having a splash-proof lid constructed in accordance with one exemplary embodiment of the present invention.
Figure 4:
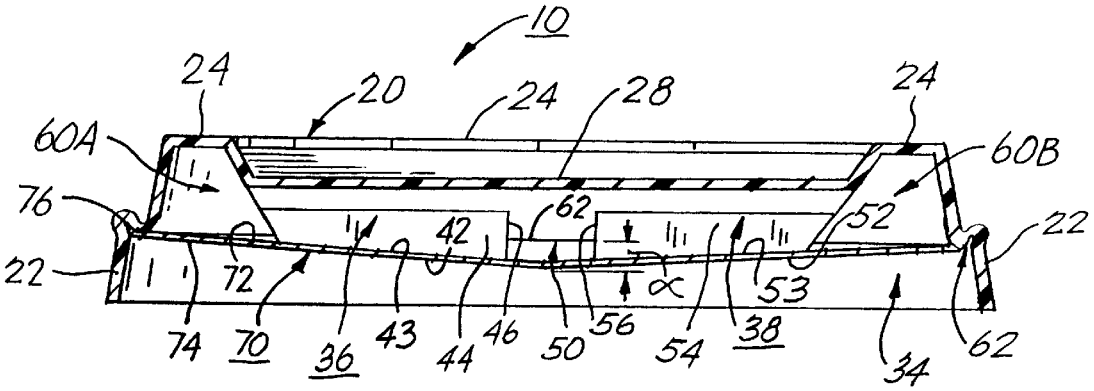
FIG. 4 is a cross-sectional view of the splash-proof lid of FIG. 1 taken along section line 4—4 and looking in the direction of the arrows.
Figure 5:
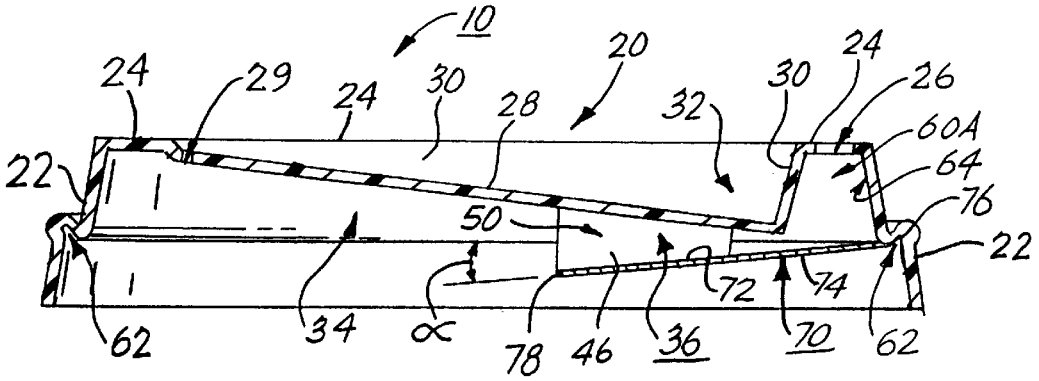
FIG. 5 is a cross-sectional view of the splash-proof lid of FIG. 1 taken along section line 5—5 and looking in the direction of the arrows.

Referring to FIG. 1, a splash-proof lid 10 is disclosed for preventing the splashing of hot or cold liquid 12 from an interior 14 of a cup or container 16, wherein the lid 10 is detachably connected to a rim section 18 of cup 16. With reference to FIGS. 1, 4 and 5, the splash-proof lid 10 includes a top wall 20 having an integrally attached curved perimeter side wall 22 for detachably connecting to the rim section 18 of cup 16. The top wall 20 includes an annular ring section 24 having a discharge outlet opening 26 therein. The outlet opening 26 is sized and shaped to allow the liquid to pass freely therethrough when the cup 16 is tilted to the user's lips (see FIGS. 6 and 7).

The top wall 20 also includes a circular planar section 28, an inner arcuate wall 30 and a front recessed (well) portion 32, wherein the planar section 28 is sloping downward relative to the front recessed portion 32 and the inner arcuate wall 30 (see FIG. 1). The top wall 20 further includes an interior underside area 34 (see FIGS. 4 and 5 especially) to be discussed hereinafter. The planar section 28 includes a vent opening 29 for exiting and venting of steam, air, carbonation, etc. in order to depressurize the closed cup 16 when filled with the liquid 12 and to prevent a vacuum from forming when the liquid 12 is drained from the cup 16. The vent opening 29 is positioned diametrically opposite from the outlet opening 26.

Figure 2:
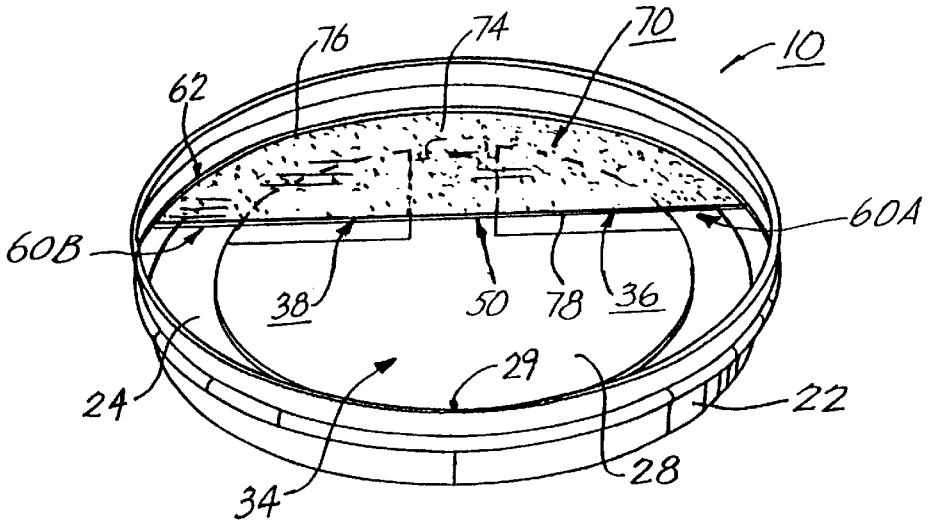
FIG. 2 is a bottom perspective view of the splash-proof lid of FIG. 1.
Figure 3:
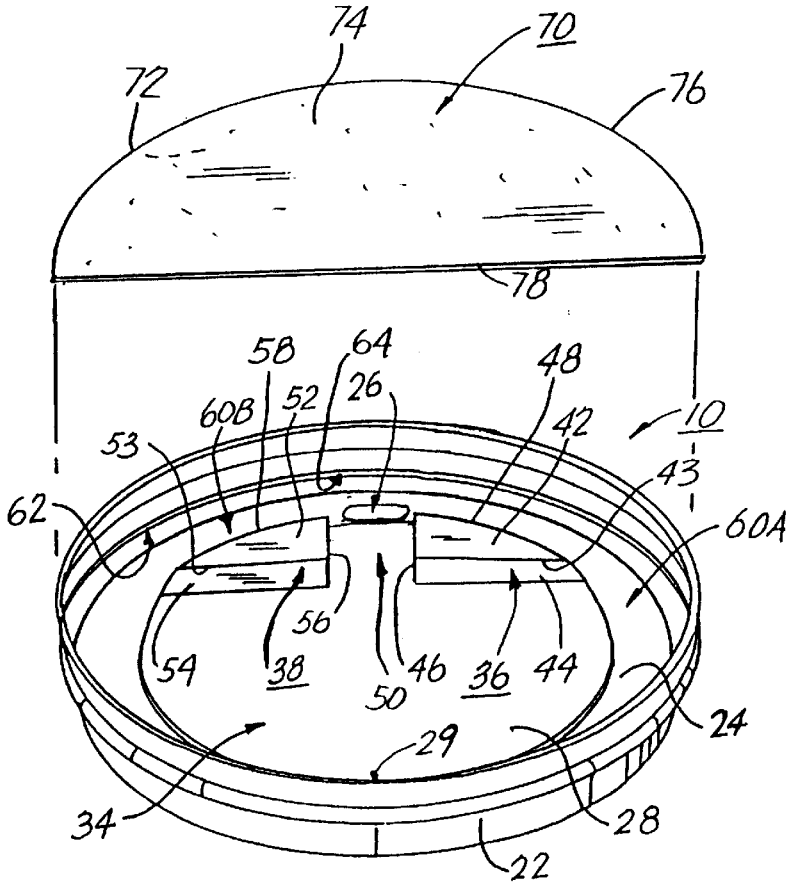
FIG. 3 is an exploded bottom perspective view of the splash-proof lid of FIG. 2.
Figure 6:
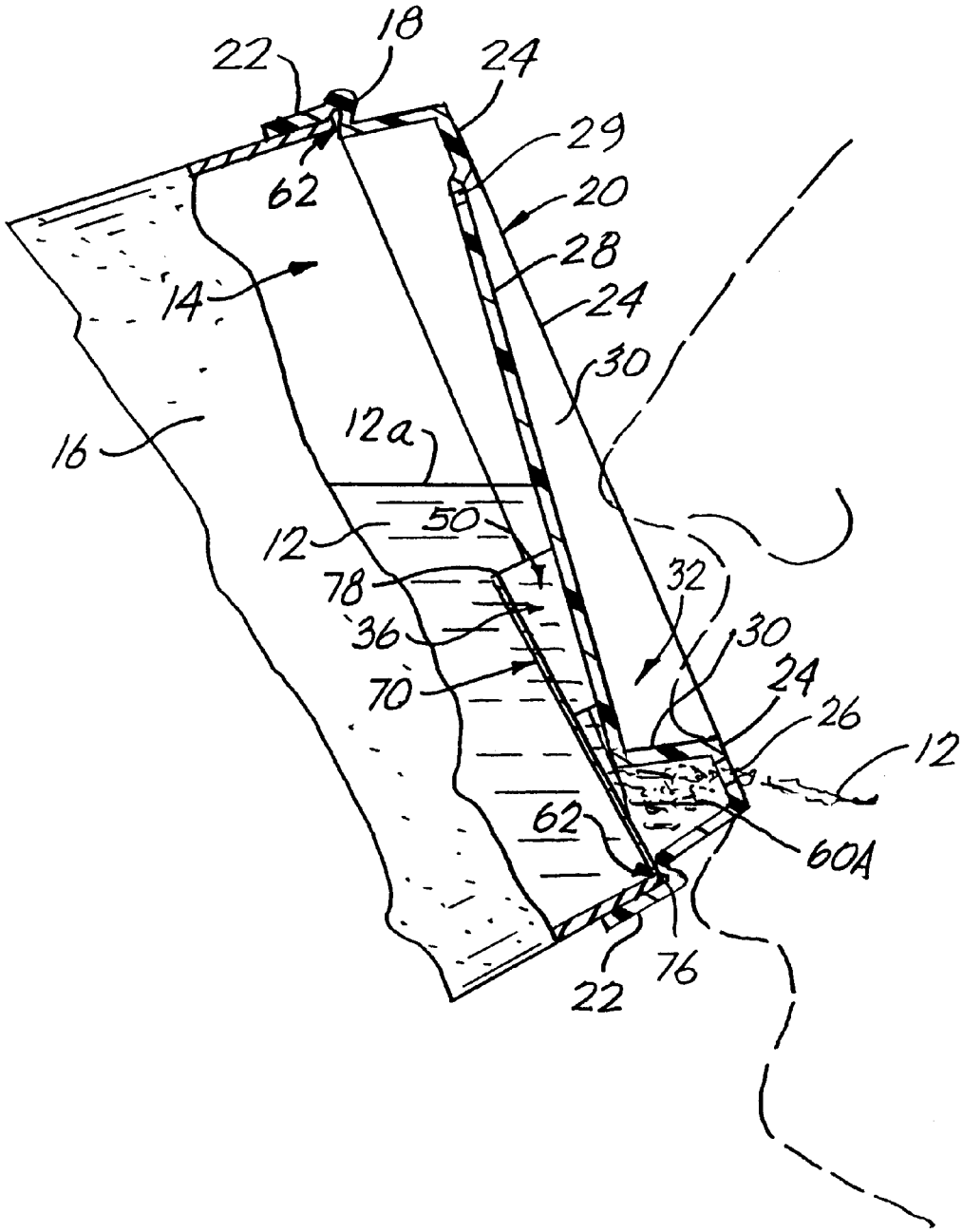
FIG. 6 is a partial cross-sectional view of the cup and lid of FIG. 1, showing the in operational use when the liquid level is above a splash guard of the lid.

With particular reference to FIGS. 1, 3 and 4, the front recessed portion 32 includes a pair of boss elements 36, 38. Each of the boss elements 36, 38 is configured to form a raised hub structure being radially tapered towards a center point of the lid 10 (see FIG. 4). The boss element 36 includes a bottom wall 42, a rear wall 44, a side wall 46 and a curved perimeter edge 48. Similarly, the boss element 38 includes a bottom wall 52, a rear wall 54, a side wall 56 and a curved perimeter edge 58. The boss elements 36 and 38 are separated from each other such that side walls 46 and 56 form a center channel 50 therebetween (see FIG. 3). Additionally, as shown in FIGS. 2, 5 and 6, the inner arcuate wall 30 and the curved perimeter side wall 22 on the underside area 34 of lid 10 form a first outer channel 60A and a second outer channel 60B for channeling and directing the liquid 12 from the interior 14 of cup 16 towards the discharge outlet opening 26 in the annular ring section 24 of the lid 10 when the user is in a drinking mode (see FIGS. 2 and 6).

The curved perimeter side wall 22 includes an interior circular lip 62 which acts as a seal component, such that the interior circular lip 62 of lid 10 is mated with the rim section 18 of cup 16 to form a detachable seal between lid 10 and cup 16 (see FIG. 1). The interior circular lip 62 includes a front section 64 to be discussed hereinafter.

Additionally, as shown in FIGS. 2 to 4, lid 10 includes a splash guard 70 having a substantially semi-circular shape. The splash guard 70 includes an upper wall surface 72, a lower wall surface 74, a curved perimeter edge 76 and a linear perimeter edge 78. The curved perimeter edge 76 of splash guard 70 is attached by attachment means, such as heat sealing, laser sealing, or hot melted adhesives, to the front section 64 of lip 62, while the linear perimeter edge 78 of splash guard 70 is attached by the aforementioned attachment means to front edges 43, 53 of the bottom walls 42, 52 of boss elements 36, 38 respectively (see FIGS. 2, 3 and 4). Additionally, the splash guard 70 has a deflection angle ($\alpha$) relative to an imaginary line beginning at the interior circular lip 62 and running parallel to the plane of the top wall 20 of lid 10. The deflection angle ($\alpha$) of the splash guard 70 assures that the draining of liquid 12 will flow from the channels 50, 60A and 60B into the interior 14 of cup 16, as will be described in greater detail hereinafter.

The splash guard 70 is made from a semi-permeable membrane material, such as a non-woven fiber substrate (similar to coffee filter paper). However, the semi-permeable material can be constructed from other materials, such as plastics or plant fibers. The materials are not critical, only that the membrane material be semi-permeable. Alternatively, the splash guard 70 could be constructed from porous materials, such as a plastic film having a plurality of openings therein. Such porous materials (e.g., a porous plastic film) would function in a similar manner as the semi-permeable membrane material described above.

The splash guard 70 can be assembled to the lid 10 at the point of manufacture. Alternatively, the splash guard 70 can be supplied as a separate after-market accessory adapted for subsequent attachment to the interior circular lip 62 of the lid 10.

In operation, the splash guard 70 located on the underside area 34 of lid 10 operates in the following manner. When the interior 14 of cup 16 has been filled with a hot or cold liquid (beverage) 12, the interior lip 62 of the lid 10 is then attached to the rim section 18 of cup 16 to form a temporary seal between lid 10 and cup 16 (see FIGS. 1, 7 and 8). In the non-drinking mode of use, the splash guard 70 prevents the splashing-out of liquid 12 from the discharge outlet opening 26 in the following way. When the liquid 12 within the cup 16 is jarred, jiggled or moved about in any way, whether in a vehicle's holder or a user's hand, the splash guard 70 acts as a barrier, such that the liquid 12 is bounced (i.e., deflected) away from the outlet opening 26. In addition, if any of the liquid 12 enters the channels 50, 60A and 60B, it is quickly drained therefrom due to the deflection angle ($\alpha$) (see FIGS. 4 and 5) of the splash guard 70. More particularly, the downwardly sloping splash guard 70 will drain the liquid 12 back into the interior 14 of the cup 16 (see FIG. 7) thereby preventing any splashing of liquid 12 from out of the discharge outlet opening 26 of lid 10. The deflection angle ($\alpha$) is in a range of from about 5° to about 15°, with a preferred deflection angle ($\alpha$) of 10°.

Figure 7:
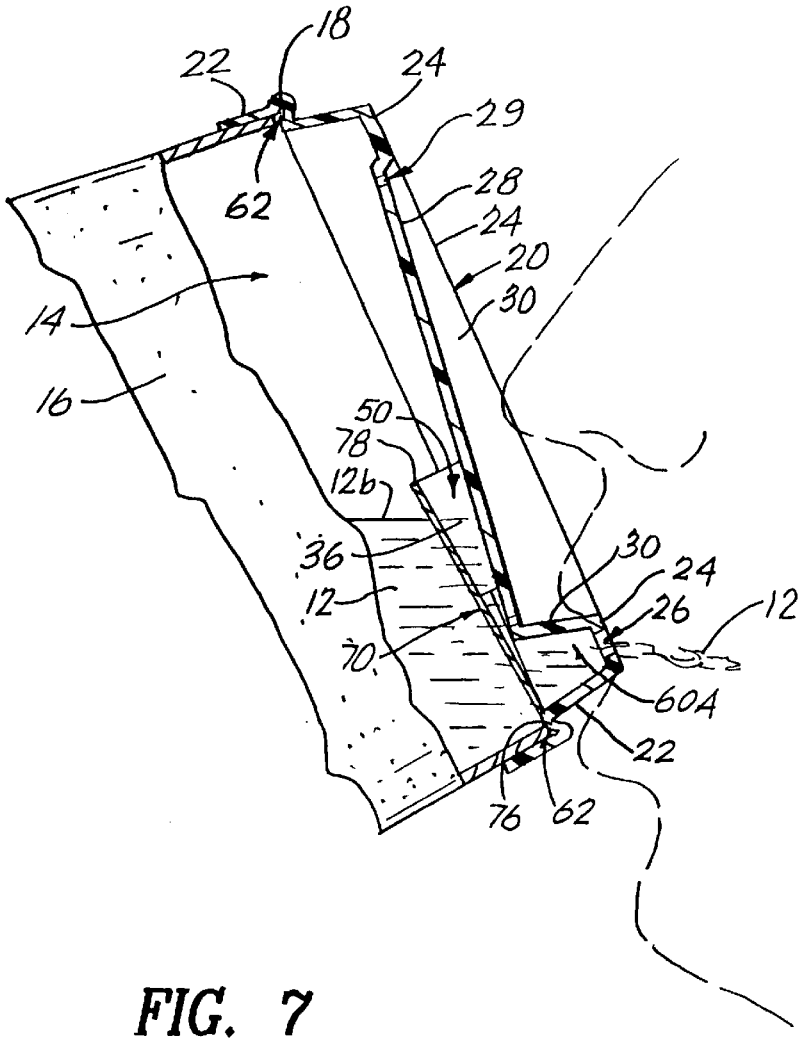
FIG. 7 is a partial cross-sectional view of the cup and lid of FIG. 1, showing the in operational use when the liquid level is below the splash guard.
Figure 8:
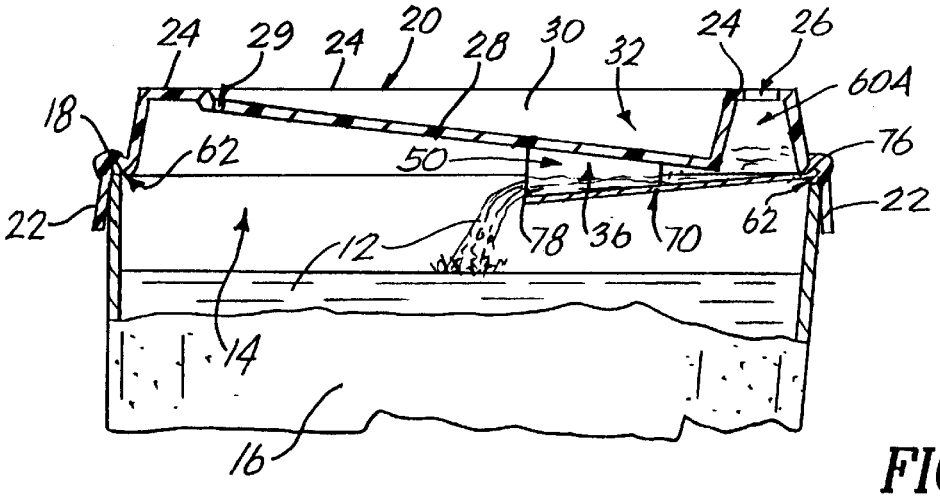
FIG. 8 is a partial cross-sectional view similar to FIGS. 6 and 7, except that the cup and lid are shown after their operational use.

During the drinking mode of use, the splash guard 70 (see FIGS. 6 and 7) does not hinder the user from drinking liquid 12 from the discharge outlet opening 26, as the liquid 12 freely flows through the outer channels 60A and 60B and the center channel 50 from the interior 14 of the cup 16. With reference to FIG. 6, when the liquid level 12*a* is above the linear perimeter edge 78 of splash guard 70, the liquid 12 can freely flow through the center channel 50 and the outer channels 60A and 60B from the interior 14 of the cup 16 in order to discharge liquid 12 from the cup 16 through the discharge outlet opening 26 of lid 10. Referring now to FIG. 7, when the liquid level 12*b* is below the perimeter edge 78 of splash guard 70, the liquid 12 is blocked by the splash guard 70 from direct access to the center channel 50 and the outer channels 60A and 60B. However, because the splash guard 70 is made from a semi-permeable membrane or is otherwise constructed to permit liquid flow therethrough, the liquid 12 can still flow freely through the splash guard 70 to the outer channels 60A and 60B and the center channel 50 from the interior 14 of the cup 16 in order to discharge the liquid 12 from the cup 16 through the discharge outlet opening 26 of lid 10. In the process of drinking a portion of liquid 12 from the cup 16, the cup 16 is repeatedly returned to an upright position or essentially vertical position (see FIG. 7), where again the splash guard 70 acts as a barrier, such that between the user's intake of the liquid 12, the channels 50, 60A and 60B formed by the splash guard 70 can drain the liquid 12 back into the interior 14 of the cup 16 (see FIGS. 4 and 7). As previously mentioned, the liquid 12 quickly drains by gravity due to the deflection angle ($\alpha$) of the splash guard 70, such that the downwardly sloping splash guard 70 promotes the drainage of the liquid 12 from the channels 50, 60A and 60B. With repeated use, eventually all of the liquid 12 can be discharged from the cup 16 through the discharge outlet opening 26.

In summary, the splash-proof lid 10 equipped with the splash guard 70 prevents any splashing of (beverage) liquid due to the strategic placement of the semi-permeable membrane material (splash guard 70) between the discharge outlet opening 26 of lid 10 and the liquid contents of a beverage container or cup 16, as shown in FIGS. 2, 6, 7 and 8.

In FIGS. 9–16, the cup 16 is shown in combination with another splash-proof lid 100 which includes a top wall 110 having an integrally attached curved perimeter side wall 112 for detachably connecting to the rim section 18 of the cup 16. The top wall 110 includes an annular ring section 114 having a discharge outlet opening 116 therein. The outlet opening 116 is sized and shaped to allow the liquid to pass freely therethrough when the cup 16 is tilted to the user's lips (see FIGS. 14 and 15). The top wall 110 also includes a rear semi-circular planar section 118, and a front recessed (well) portion 120, wherein the rear planar section 118 is at a higher elevation relative to the front recessed portion 120 (see FIG. 9). The top wall 110 further includes an interior underside area 122 (see FIGS. 11, 12 and 13) to be discussed hereinafter. The rear planar section 118 includes a vent opening 124 for exiting and venting of steam, air, carbonation, etc. in order to depressurize the closed cup 16 when filled with the liquid 12, and to prevent a vacuum from forming when the liquid 12 is drained from the cup 16. The vent opening 124 is positioned diametrically opposite from the outlet opening 116. The front recessed portion 120 is defined by an inner straight wall 130 sloping downward relative to the rear planar section 126, an inner arcuate wall 132 sloping downward relative to the outlet opening 116 of the ring section 114, and a bottom (floor) wall section 134 sloping downward relative to the inner straight wall 130 towards the inner arcuate wall 132.

Figure 9:
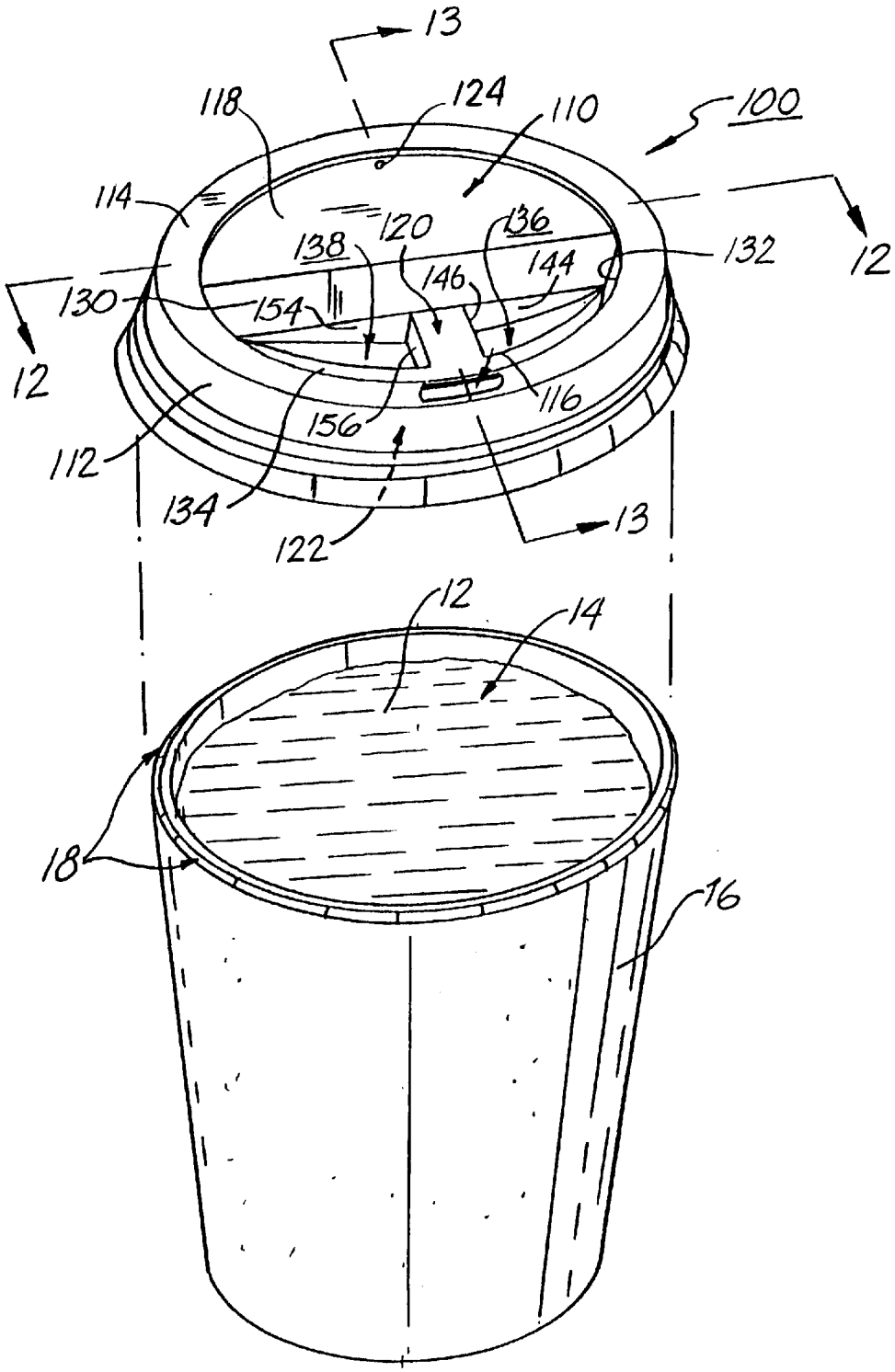
FIG. 9 is an exploded top perspective view of the drinking cup of FIG. 1, which has been provided with a splash-proof lid constructed in accordance with another exemplary embodiment of the present invention.
Figure 10:
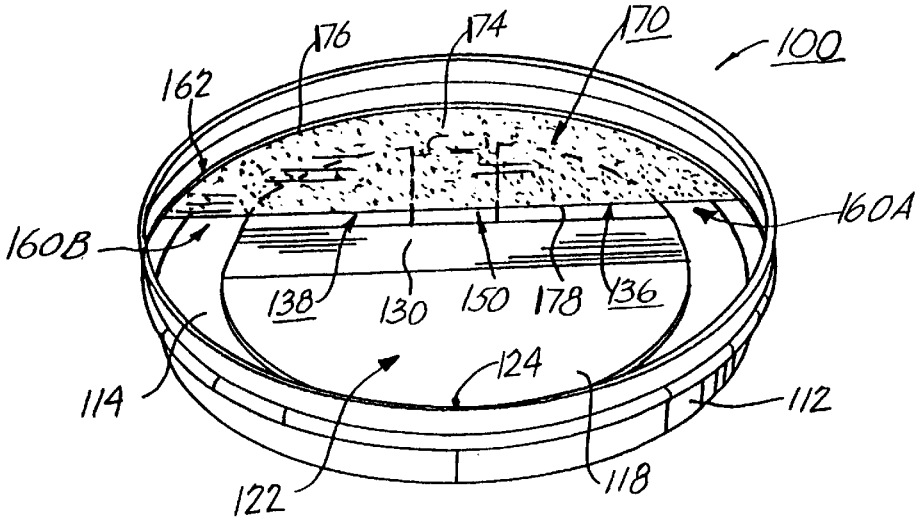
FIG. 10 is a bottom perspective view of the splash-proof lid of FIG. 9.
Figure 11:
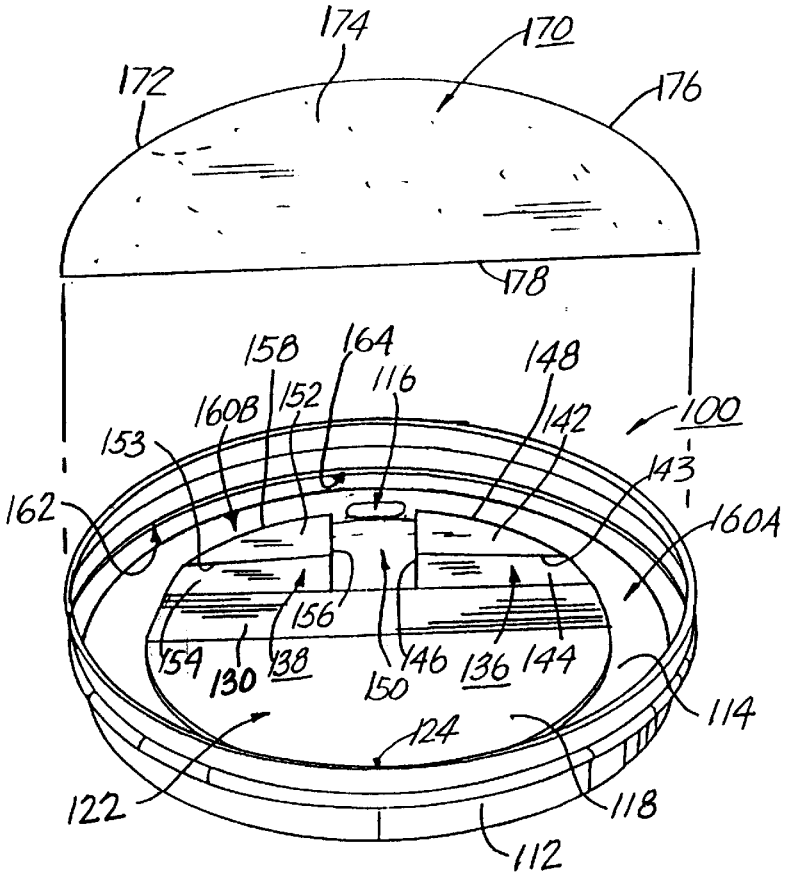
FIG. 11 is an exploded bottom perspective view of the splash-proof lid of FIG. 10.
Figure 12:
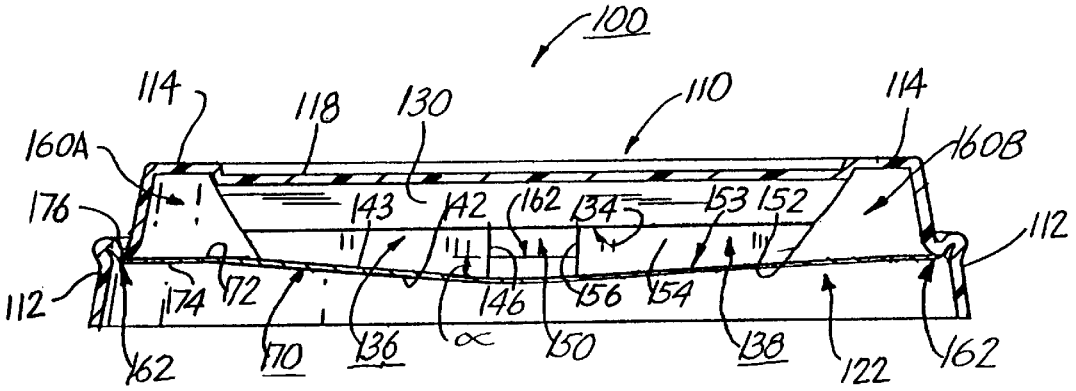
FIG. 12 is a cross-sectional view of the splash-proof lid of FIG. 9 taken along section line 12—12 and looking in the direction of the arrows.
Figure 13:
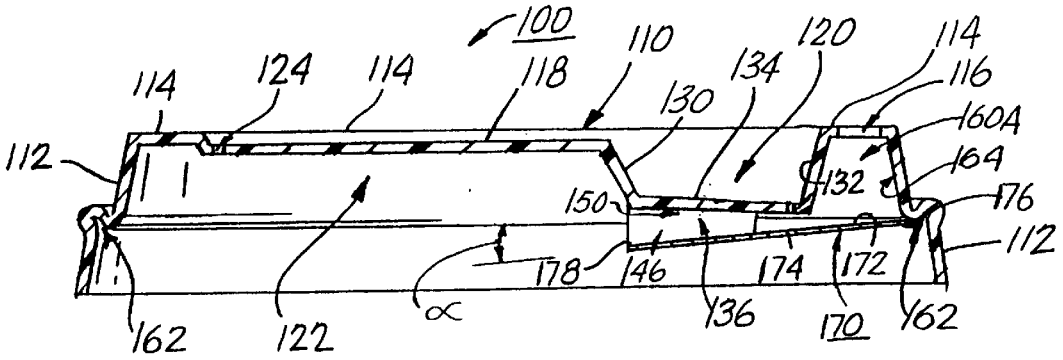
FIG. 13 is a cross-sectional view of the splash-proof lid of FIG. 9 taken along section line 13—13 and looking in the direction of the arrows.
Figure 14:
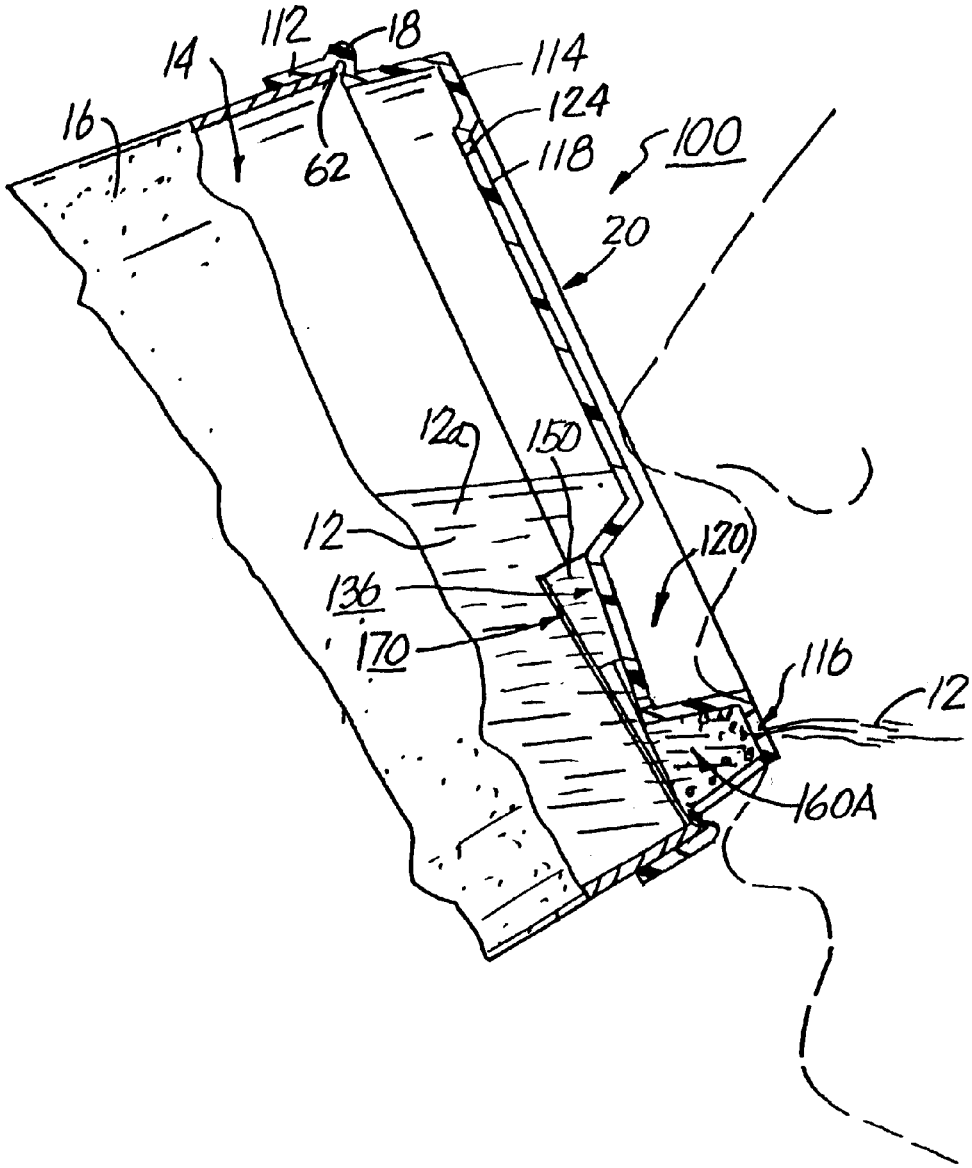
FIG. 14 is a partial cross-sectional view of the cup and lid of FIG. 9, showing the in operational use when the liquid level is above a splash guard of the lid.
Figure 15:
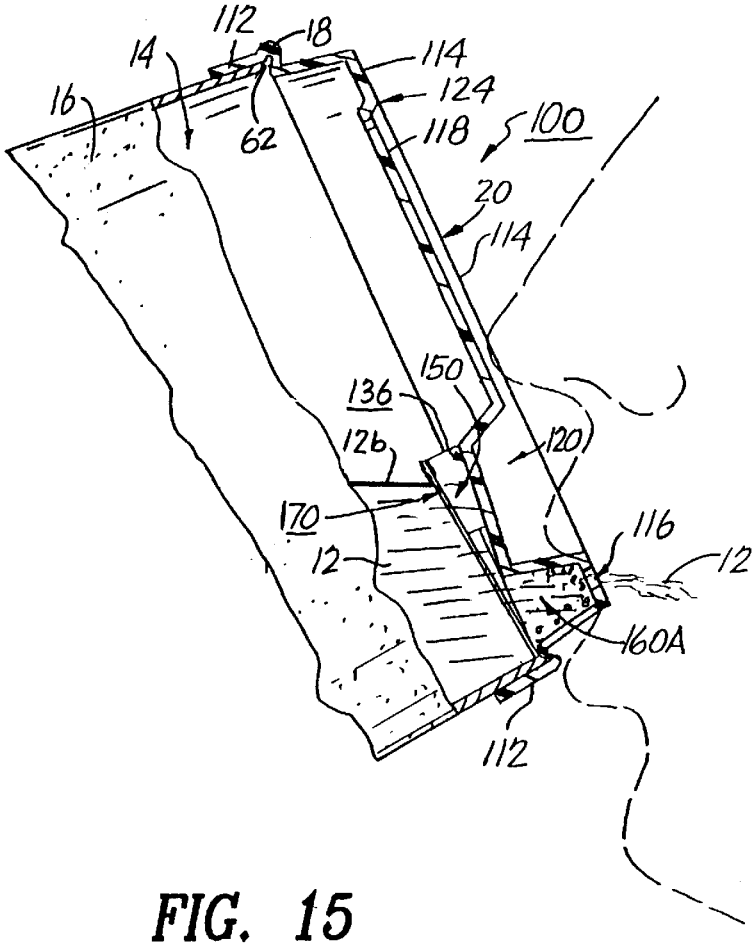
FIG. 15 is a partial cross-sectional view of the cup and lid of FIG. 9, showing the in operational use when the liquid level is below the splash guard.
Figure 16:
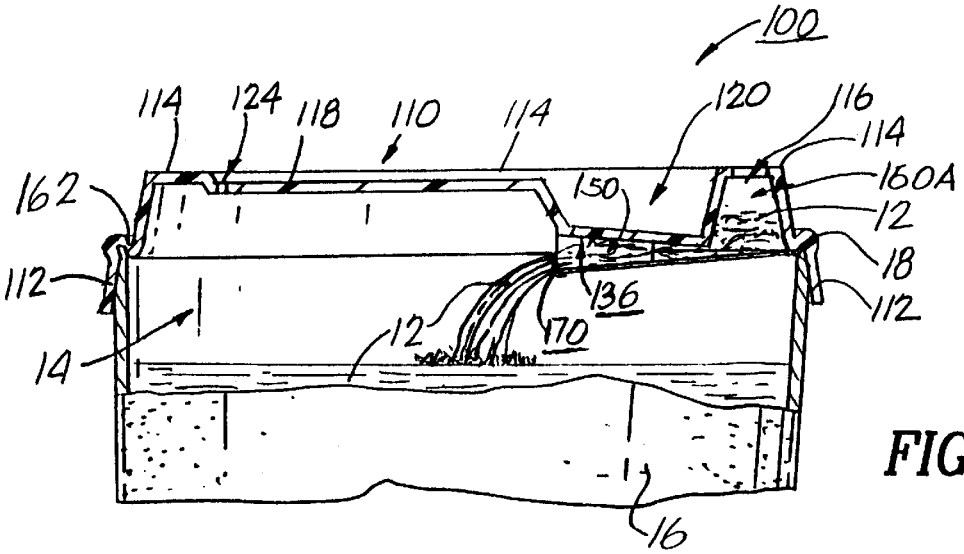
FIG. 16 is a partial cross-sectional view similar to FIGS. 14 and 15, except that the cup and lid are shown after their operational use.

With particular reference to FIGS. 9, 11 and 12, the bottom wall section 134 also includes a pair of boss elements 136, 138. Each of the boss elements 136, 138 is configured to form a raised hub structure being radially tapered towards a center point of the lid 10 (see FIG. 12). The boss element 136 includes a bottom wall 142, a rear wall 144, a side wall 146 and a curved perimeter edge 148. Similarly, the boss element 138 includes a bottom wall 152, a rear wall 154, a side wall 156 and a curved perimeter edge 158. The boss elements 136 and 138 are separated from each other such that side walls 146 and 156 form a center channel 150 therebetween (see FIG. 11). Additionally, as shown in FIGS. 10, 13 and 14, the inner arcuate wall 132 and the curved perimeter side wall 112 on the underside area 122 of lid 100 form a first outer channel 160A and a second outer channel 160B for channeling and directing the liquid 12 from the interior 14 of cup 16 towards the discharge outlet opening 116 in the annular ring section 114 of the lid 100 when the user is in a drinking mode (see FIGS. 14 and 15).

The curved perimeter side wall 112 includes an interior circular lip 162 which acts as a seal component, such that the interior circular lip 162 of lid 100 is mated with the rim section 18 of cup 16 to form a detachable seal between lid 100 and cup 16 (see FIG. 9). The interior circular lip 62 includes a front section 164 to be discussed hereinafter.

Additionally, as shown in FIGS. 10—12, the lid 100 includes a splash guard 170, which is essentially identical to the splash guard 70 of FIGS. 1—9. Thus, the splash guard 170 includes an upper wall surface 172, a lower wall surface 174, a curved perimeter edge 176 and a linear perimeter edge 178. The curved perimeter edge 176 of splash guard 170 is attached by attachment means, such as heat sealing, laser sealing, or hot melted adhesives, to the front section 164 of lip 162, while the linear perimeter edge 178 of splash guard 170 is attached by the aforementioned attachment means to front edges 143, 153 of the bottom walls 142, 152 of boss elements 136, 138 respectively (see FIGS. 10, 11 and 12). Additionally the splash guard 170 has a deflection angle ($\alpha$) relative to an imaginary line beginning at the interior circular lip 162 and running parallel to the plane of the top wall 110 of lid 100. The deflection angle ($\alpha$) of the splash guard 170 assures that the draining liquid will flow from the channels 150, 160A and 160B into the interior 14 of cup 16, as will be described in greater detail hereinafter.

In operation, the splash guard 170 operates in exactly the same manner as the splash guard 70 of FIGS. 1–8. Thus, the splash-proof lid 100 equipped with the splash guard 170 prevents any splashing of (beverage) liquid due to the strategic placement of the semi-permeable membrane material (splash guard 170) between the discharge outlet opening 116 of lid 100 and the liquid contents of a beverage container or cup 16, as shown in FIGS. 10, 14, 15 and 16.

Figure 17:
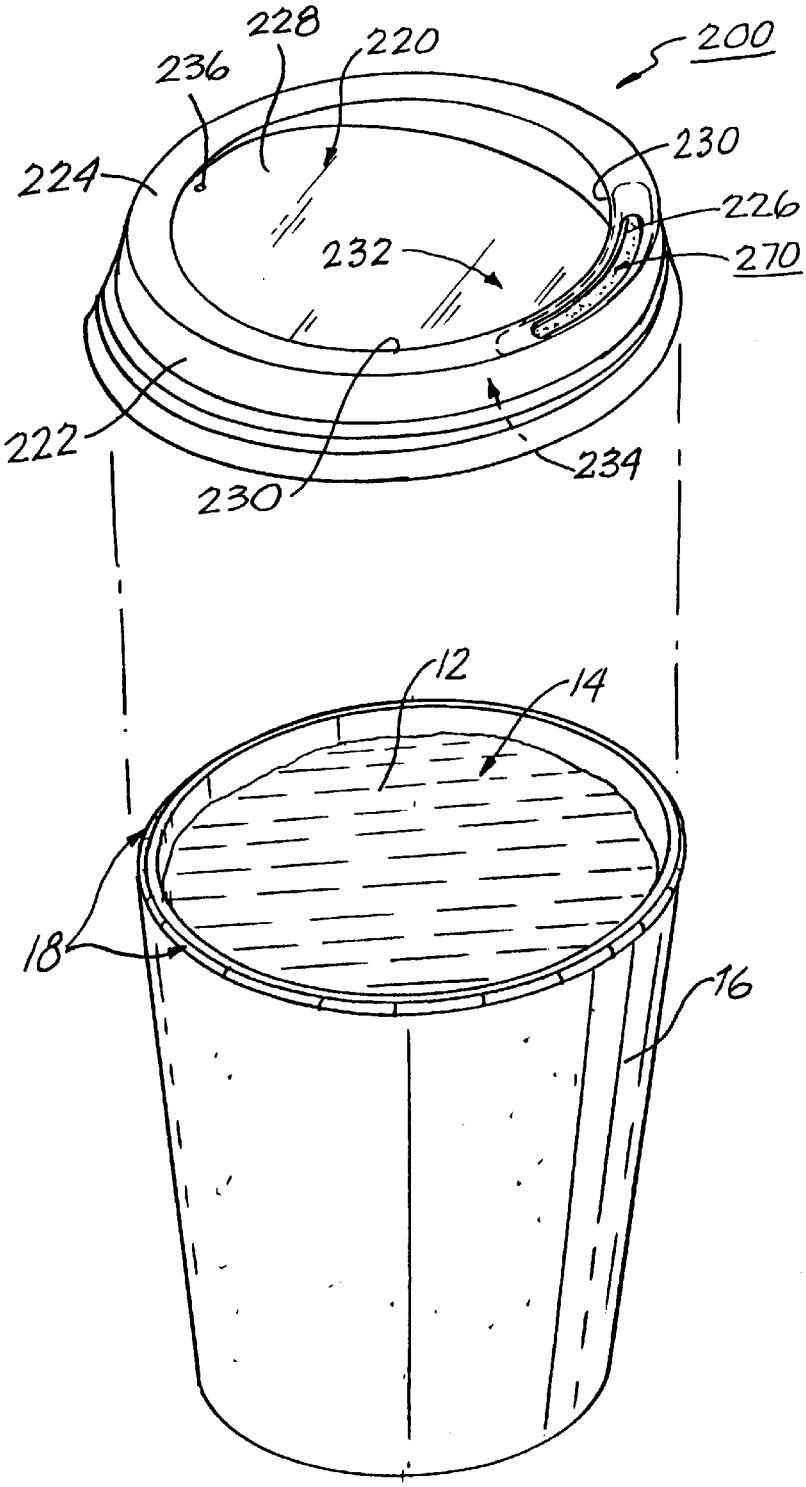
FIG. 17 is an exploded top perspective view of the drinking cup of FIG. 1, which has been provided with a splash-proof lid constructed in accordance with yet another exemplary embodiment of the present invention.
Figure 18:
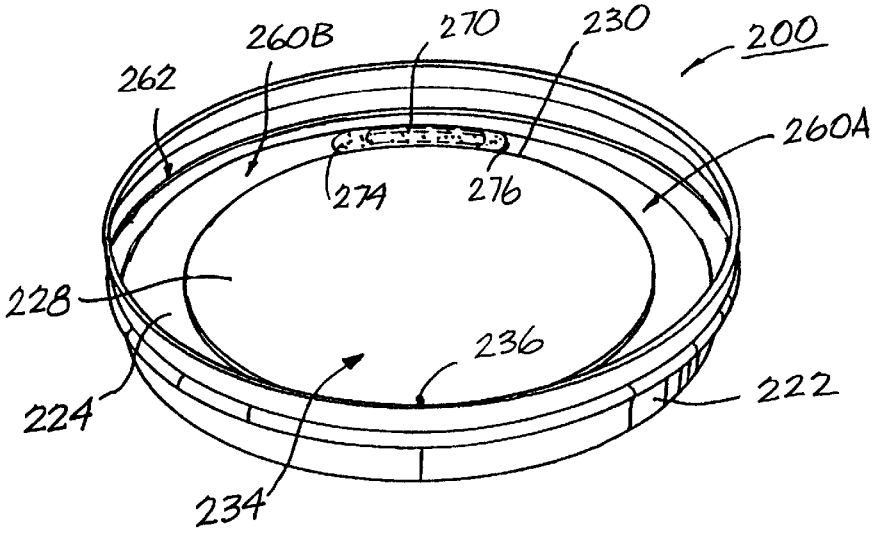
FIG. 18 is a bottom perspective view of the splash-proof lid of FIG. 17.
Figure 19:
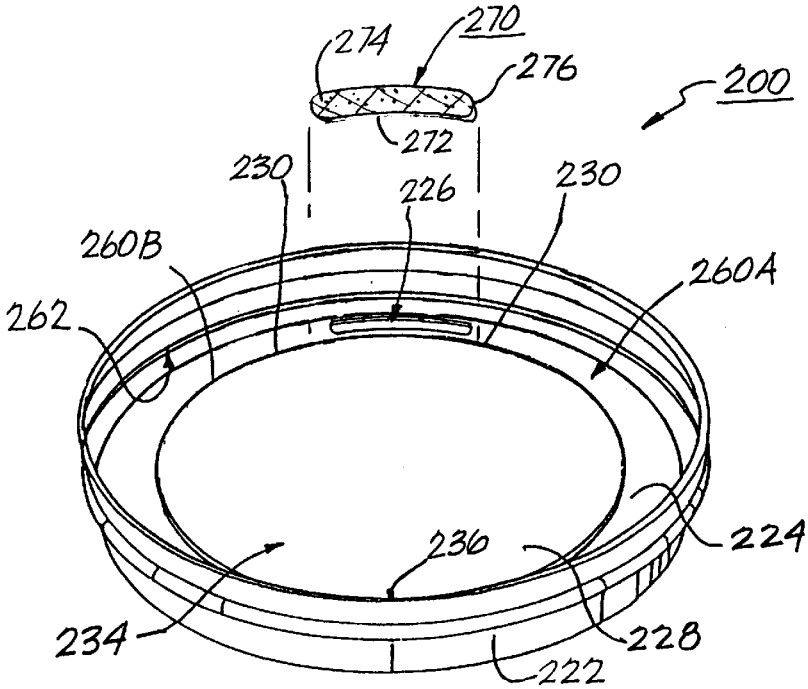
FIG. 19 is an exploded bottom perspective view of the splash-proof lid of FIG. 18.

In FIGS. 17–19, the cup 16 is shown in combination with yet another splash-proof lid 200, which is detachably connected to the rim section 18 of the cup 16. More particularly, the splash-proof lid 200 includes a top wall 220 having an integrally attached curved perimeter side wall 222 for detachably connecting to the rim section 18 of the cup 16. The top wall 220 includes an annular ring section 224 having a discharge outlet opening 226 therein. The outlet opening 226 is sized and shaped to allow the liquid to pass freely therethrough when the cup 16 is tilted to the user's lips.

The top wall 220 also includes a circular planar section 228, an inner arcuate wall 230 and a front recessed (well) portion 232, wherein the planar section 228 is sloping downward relative to the front recessed portion 232 and the inner arcuate wall 230 (see FIG. 17). The top wall 220 further includes an interior underside area 234 to be discussed hereinafter. The planar section 228 includes a vent opening 236 for exiting and venting of steam, air, carbonation, etc. in order to depressurize the closed cup 16 when filled with the liquid 12, and to prevent a vacuum from forming when the liquid 12 is drained from the cup 16. The vent opening 236 is positioned diametrically opposite from the outlet opening 226. The curved perimeter side wall 222 includes an interior circular lip 262 which acts as a seal component, such that the interior circular lip 262 of lid 200 is mated with the rim section 18 of the cup 16 to form a detachable seal between the lid 200 and the cup 16.

Additionally, as shown in FIGS. 17–19, the lid 200 includes a splash guard 270 that is sized and shaped to completely cover outlet opening 226. The splash guard 270 includes an upper wall surface 272, a lower wall surface 274, and a curved perimeter edging 276. The curved perimeter edging 276 of splash guard 270 is attached by attachment means, such as heat sealing, laser sealing, or hot melted adhesives to the annular ring section 224 around the discharge outlet opening 226 (see FIGS. 18 and 19).

Like the splash guard 70 of FIGS. 1–8 and the splash guard 170 of FIGS. 9–16, the splash guard 270 can be made from a semi-permeable membrane material, such as a non-woven fiber substrate (similar to coffee filter paper). However, the splash guard 270 has a higher porosity, and hence less resistance to liquid flow, than the splash guards 70 and 170. It is possible to construct the splash guard 270 from other materials, such as plastics or plant fibers. The materials are not critical, only that the membrane material be semi-permeable and have a higher porosity than the splash guards 70 and 170. Alternatively, the splash guard 270 could be constructed from porous materials, such as a plastic film having a plurality of openings therein. Such porous materials (e.g., a porous plastic film) would function in a similar manner as the semi-permeable membrane material described above.

In operation, the splash guard 270 located on the underside area 234 of lid 200 operates in a standard manner of drinking liquid through the discharge outlet opening 226 of lid 200, except for the splash guard 270 covering the outlet opening 226. So as not to have a deleterious affect on the operation of the lid 200, the porosity of the splash guard 270 and the size of the outlet opening 226 are specifically selected so as to permit an acceptable flow rate of the liquid 12 from the cup 12 through the lid 200 and to the user (not shown).

In summary, the splash-proof lid 200 equipped with the splash guard 270 prevents any splashing of (beverage) liquid due to the strategic placement of the semi-permeable membrane material (splash guard 270) between the discharge outlet opening 226 of the liquid contents of a beverage container or cup 16.

It should be understood that the embodiments described herein are merely exemplary and that a person skilled in the art may make many variations and modifications without departing from the spirit and scope of the invention. All such variations and modifications are intended to be included within the scope of the invention as defined in the appended claims.

What is claimed is:

1. In a splash-proof lid for a drinking cup, which lid includes a discharge opening and a splash guard underlying said discharge opening, the improvement wherein said splash guard is made from a semi-permeable material which extends over only a portion of an open bottom of said lid, said splash guard being spaced from said discharge opening so as to form at least one unobstructed flow channel between said discharge opening and said splash guard whereby liquid can flow to said discharge opening through said at least one unobstructed flow channel and through said splash guard itself.

2. The improved splash-proof lid of claim 1, wherein said semi-permeable material is a non-woven fiber substrate which permits liquid to flow therethrough.

3. The improved splash-proof lid of claim 1, wherein said semi-permeable material is filter paper which permits liquid to flow therethrough.

4. The improved splash-proof lid of claim 1, wherein said semi-permeable material is a plastic film having a plurality of openings sized and shaped so as to permit liquid to flow therethrough.

5. The improved splash-proof lid of claim 1, wherein said splash guard is completely sealed about said discharge opening.

6. The improved splash-proof lid of claim 1, wherein said splash guard slopes away from said discharge opening, whereby undrunk liquid between said discharge opening and said splash guard automatically drains by gravity away from said discharge opening.

7. The improved splash-proof lid of claim 6, wherein said splash guard is arranged at an angle relative to a plane which contains said discharge opening.

8. The improved splash-proof lid of claim 7, wherein said angle is in a range of from about 5° to about 15°.

9. The improved splash-proof lid of claim 8, wherein said angle is 10°.

10. The improved splash-proof lid of claim 1, the improvement further comprising a pair of spaced-apart bosses depending from a top wall of said lid.

11. The improved splash-proof lid of claim 10, wherein said bosses space said splash guard from said discharge opening, said bosses cooperating with said splash guard to form said at least one unobstructed flow channel.

12. In a splash-proof lid for a drinking cup, which lid includes a discharge opening and a splash guard underlying said discharge opening, the improvement wherein said splash guard is made from a semi-permeable material and is semi-circular in shape; and wherein said lid includes a pair of spaced-apart bosses depending from a top wall of said lid, said bosses spacing said splash guard from said discharge opening so as to form at least one flow channel, whereby liquid can flow to said discharge opening through said at least one flow channel and through said splash guard itself.

13. The improved splash-proof lid of claim 12, wherein said splash guard has a curved perimeter edge and a linear perimeter edge.

14. The improved splash-proof lid of claim 13, wherein said lid includes attaching means for attaching said lid to a drinking cup.

15. The improved splash-proof lid of claim 14, wherein said attaching means includes an interior circular lip depending from said top wall of said lid.

16. The improved splash-proof lid of claim 15, wherein one of said bosses is spaced from a first portion of said circular lip on one side of said lid and the other of said bosses is spaced from a second portion of said circular lip on an opposite side of said lid.

17. The improved splash-proof lid of claim 16, wherein said linear perimeter edge of said splash guard is attached to each of said bosses and said curved perimeter edge of said splash guard is attached to an arcuate segment of said circular lip.

18. The improved splash-proof lid of claim 17, wherein said at least one unobstructed flow channel includes a first flow channel between said bosses, a second flow channel between said one boss and said first portion of said circular lip, and a third flow channel between said other boss and said second portion of said circular lip.

19. The improved splash-proof lid of claim 18, wherein said bosses are radially tapered toward a center point of said lid, whereby said linear perimeter edge of said splash guard is similarly tapered.

* * * * *